United States Patent [19]

Palmer

[11] 4,201,231

[45] May 6, 1980

[54] PIPE COVER AND HOLDER

[76] Inventor: Michael A. Palmer, 815 W. 14th St., Williston, N. Dak. 58801

[21] Appl. No.: 854,091

[22] Filed: Nov. 23, 1977

[51] Int. Cl.[2] ..... A24F 5/10

[52] U.S. Cl. ..... 131/176

[58] Field of Search ..... 131/176, 177, 174, 191, 131/200, 201

[56] References Cited

U.S. PATENT DOCUMENTS

| | | | |
|---|---|---|---|
| 329,873 | 11/1885 | Wyatt | 131/201 |
| 598,086 | 2/1898 | Hannan | 131/205 |
| 699,480 | 5/1902 | Bowman | 131/176 |
| 932,269 | 8/1909 | Gloede | 131/176 |
| 1,388,733 | 8/1921 | McGuckin | 131/191 |
| 1,541,727 | 6/1925 | Meyer | 131/176 |
| 2,010,708 | 8/1935 | Adams | 131/12 |
| 2,107,591 | 2/1938 | Walker et al. | 131/133 R |
| 2,144,393 | 1/1939 | Schnaier | 131/176 |
| 2,454,436 | 11/1948 | Dietz | 131/176 |
| 2,890,705 | 6/1959 | Beck | 131/174 |

FOREIGN PATENT DOCUMENTS

| | | | |
|---|---|---|---|
| 612278 | 10/1926 | France | 131/176 |
| 101727 | 10/1916 | United Kingdom | 131/176 |
| 234908 | 8/1925 | United Kingdom | 131/176 |

*Primary Examiner*—Stephen C. Pellegrino
*Attorney, Agent, or Firm*—Young & Martin

[57] ABSTRACT

A pipe holder and bowl cover for a smoker's pipe is comprised of a spherical mass of open-celled spongy plastic foam with a bowl receiving bore provided therein and dimensioned to frictionally secure the bowl cover to the bowl of the pipe. A retaining screen is mounted within the bore so as to contact the upper rim of the pipe bowl when the bowl cover is secured to the bowl thereby preventing the escape of a tobacco or like substance that is placed in the bowl.

8 Claims, 6 Drawing Figures

PIPE COVER AND HOLDER

BACKGROUND OF THE INVENTION

This invention relates generally to smoking paraphernalia and more specifically to a pipe cover and holder.

Numerous problems have been encountered with the use of smoking apparatus, particularly pipes, wherein a smokable substance is tamped into the bowl, the substance ignited, and the smoke inhaled by the user as the substance smolders. Besides the problems of maintaining combustion of the material while the pipe is in use and the pipe cleaning problems which a smoker encounters, further problems arise from the use of a pipe around fine furniture, rugs and the like.

In particular, the potential for spillage of the burning substance creates problems because the hot embers may scorch or burn items onto which it falls. It is desirable to eliminate, to the extent possible, the danger of this spillage, and to maintain the smokable substance within the pipe even though the pipe, for some reason, may overturn.

Most conventional pipes have rounded bowl members or insufficient supporting base portions so that when placed on a flat surface they will lay on their sides rather than setting with the bowls in an upright position. Further, when several persons are sharing a common pipe, there is more danger that the pipe will be dropped inadvertently when being passed from one person to another than if only one person is using the pipe. For these reasons it is desired that there be some way of preventing spillage of the hot embers by retaining them within the bowl of the pipe in the event that the bowl is tipped over or becomes inverted, and it would be beneficial if the pipe could be provided with a cover or holder that would return the pipe to an upright position in the event it is dropped or carelessly set down on its side or top while retaining the smoldering embers within the pipe bowl.

SUMMARY OF THE INVENTION

Accordingly, it is an object of the present invention to provide a bowl cover for a common tobacco pipe which will prevent spillage of a smokable substance placed in the pipe regardless of the orientation of the bowl portion of the pipe.

It is another object of the present invention to provide a bowl cover which will elastically fit over the bowl portion of a common tobacco pipe so that it may be frictionally secured thereon.

A still further object of the present invention is to provide a bowl cover which is made of an elastic, open-celled material light in weight and permeable to air which will fit over a bowl portion of a common tobacco pipe and have means for retaining a smokable substance within the bowl portion of the pipe and in isolation from the elastic material.

It is a still further objective of the present invention to provide a bowl cover which, when mounted on the bowl portion of a pipe, will cause the bowl portion to automatically seek an upright position when the pipe is placed on a flat surface.

Another object of the present invention is to provide a holder and bowl cover for a pipe including a bore for receiving the bowl portion of a pipe and having air passages connecting the bore to the exterior of the cover to allow oxygen to reach the smokable substance and products of combustion to escape when the bowl cover is secured to the pipe.

Still another object of the present invention is to provide a bowl cover for a pipe fabricated of an elastic, open-celled material which filters particulate matter from the products of combustion before they escape into the air and which is washable for periodic cleaning of the filtering cover.

It is a further object of the present invention to provide a spherical bowl cover made of a lightweight, open-celled elastic material having a bore for receiving the bowl portion of a pipe wherein the sphere is of such diametrical dimension to cause the pipe to automatically seek an upright position when placed on a flat surface while having means for retaining the smokable substance within the bowl portion of the pipe and out of contact with the elastic material when the bowl portion of the pipe is not in an upright position.

With the problems relating to spillage of the smokable substance placed within the pipe in mind, the present invention contemplates a pipe cover which serves both to retain the smoking substance in the event the pipe is tipped over or becomes inverted while at the same time providing a convenient holder for the smoker's pipe. The invention basically includes a bowl cover which is adapted to be releasably secured over the open end of the bowl of a common tobacco pipe so as to define a closed chamber which encloses a major portion of the bowl. This cover, although removable, is secured by friction or snug-fitting engagememt with the outer sides of the bowl portion of the smoker's pipe.

The main body of the bowl cover is comprised of an open-celled, sponge-like material, such as a foam plastic, which is permeable to air so as to allow the air to pass freely therethrough. This open-celled material also has the characteristic of elasticity. A bore slightly smaller in diameter than the outside diameter of the bowl portion of a common tobacco pipe extends radially inwardly from the peripheral surface of this mass of elastic, open-celled material. A screen is positioned within the bore so that when the bore is expanded and slid down over the bowl portion of a pipe, the upper rim of the bowl portion will abut the screen thereby preventing a substance which is placed in the bowl both from falling out of the pipe and from direct contact with the spongy material. The sponge material preferably is permeable to air so that the burning tobacco will not be extinguished by lack of oxygen, and so the pipc can be smoked with the cover in place. Thus, when the smoker inhales on the stem portion of the pipe, air can be drawn in through the bowl cover and then through the pipe.

The sponge material also acts as a filter to trap particulate matter in the smoke to prevent them from escaping into the surrounding environment, thereby decreasing the odor created by the pipe and its resulting annoyance to other persons in the vicinity. The sponge material is also washable, so the cover can be periodically cleaned.

Not only does this bowl cover operate to define an enclosed chamber for holding the smokable substance in the event that the pipe is tipped over or inverted, but also the bowl cover is designed to insure that the bowl portion of the pipe will automatically return to a somewhat upright position regardless of its orientation when the pipe is either placed or dropped on a flat surface. Since many materials which exhibit the feature of open-celled construction are also relatively light in weight, the proper geometric configuration and dimensioning of the bowl cover, such as, in a spherical configuration of relatively large diameter in relation to the bowl size of the pipe, will insure that the bowl portion will return to that upright position. When the cover of such geometric configuration and size is placed on the pipe by insertion of the bowl portion into the bore, the center of gravity for the assembled structure will be positioned near a peripheral portion of the bowl cover near the bowl. The spherical cover will seek a state of stable equilibrium wherein the bowl portion is substantially upright.

BRIEF DESCRIPTION OF THE DRAWINGS

Other objects, advantages and features of the present invention become more apparent as the description proceeds, taken in conjunction with the accompanying drawings, in which.

DETAILED DESCRIPTION OF THE PREFERRED EMBODIMENT

Figure 1:
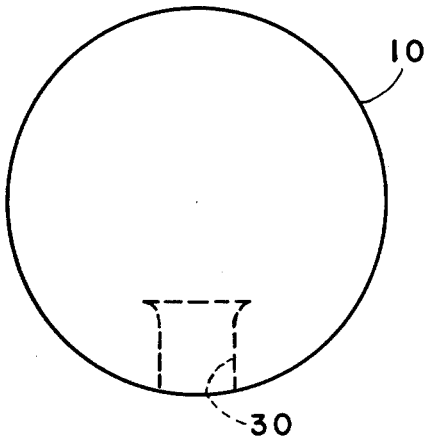
FIG. 1 is a side elevation view of the pipe bowl cover and holder of the present invention with the internal bore and screen shown in phantom lines.
Figure 2:
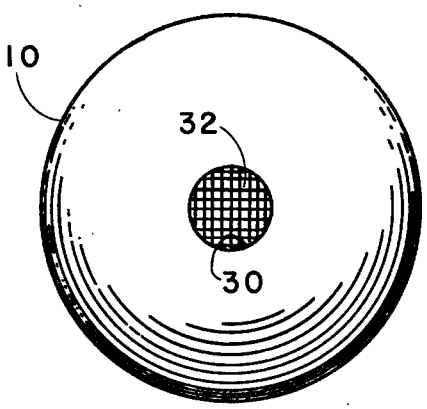
FIG. 2 is a bottom plan view of the pipe bowl cover and holder illustrating the bore and internal screen.

The pipe holder and bowl cover 10 of the present invention is shown in FIGS. 1 and 2. It is spherical in shape, preferably fabricated of an elastic, open-celled sponge rubber or similar material and has an axial bore 30 extending diametrically upward from its peripheral surface toward the center of the sphere. A screen 22 is positioned in the bore transverse to the axis of the bore a distance from the peripheral surface approximately equal to the external height of the bowl 14 of an associated smoking pipe 12. The diameter of the bore 30 is preferably slightly less than the diameter of the pipe bowl 14.

Figure 5:
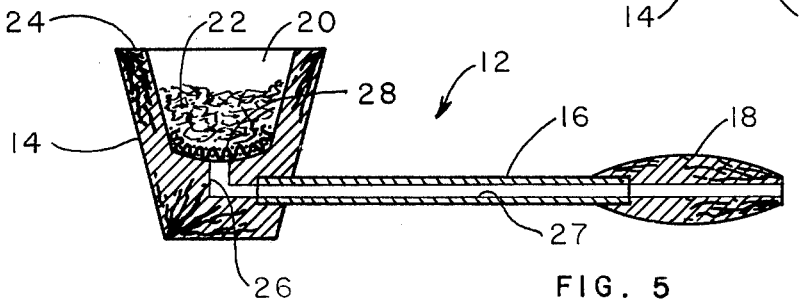
FIG. 5 is a side elevation view in section of the pipe.
Figure 6:
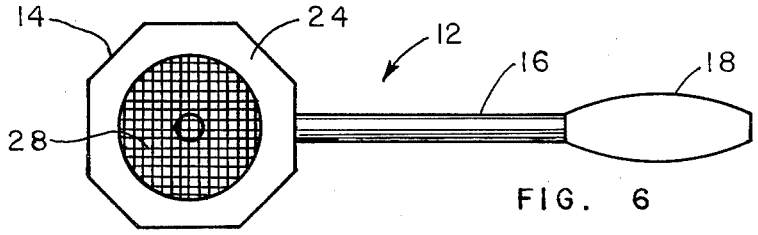
FIG. 6 is a top plan view of the pipe.

FIGS. 5 and 6 illustrate a typical smoking pipe 12 on which the holder and bowl cover 10 is to be used. The pipe 12 is comprised of a bowl portion 14, stem portion 16, and mouthpiece 18. The bowl 14 is in the form of an open or cup-shaped chamber 20 into which a smokable substance 22, such as tobacco, herbs, or other material is placed. The bowl 14 has an annular rim 24 around its opening and an outlet bore 26 is provided on a lower portion of bowl 14 in communication with a longitudinal conduit 27 through hollow stem 16 so that smoke may be drawn out of the bowl and into the smoker's mouth through a stem 16 and mouthpiece 21. Bowl 14 is also provided with a screen support 28 positioned transversely in the chamber 20 between rim 24 and outlet bore 26. Screen 28 acts as a base or support for the smokable substance 22 in the chamber 20 while allowing air and smoke to be drawn therethrough by the smoker and into his mouth. Support screen 24 may be releasably affixed to inner surface of bowl 14.

The open-celled sponge rubber material of the cover 10 allows air to reach the smokable substance 22 in the pipe bowl 20 to support combustion of the substance 22, and it allows the gaseous products of combustion to escape into the atmosphere. However, because the escaping products of combustion must travel through tortuous paths of very small openings in the sponge material, the cover 10 filters out much of the particulate products of combustion and retains them so the smoking odor of the pipe in the adjacent environment and its accompanying annoyance to others in the vicinity is substantially reduced. The sponge rubber material is also washable, so the cover 10 can be cleaned periodically to maintain its efficiency and cleanliness by washing out the trapped particulate matter, for example, in soap and water.

Figure 3:
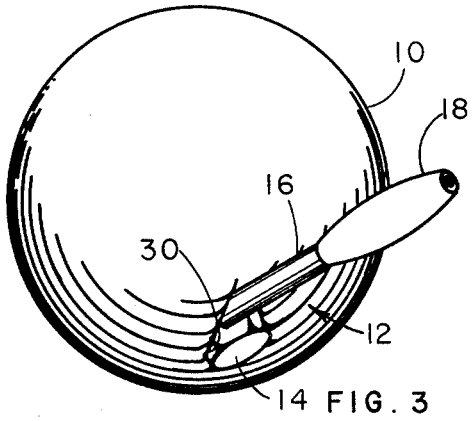
FIG. 3 is a perspective view of the cover and holder in position with the bowl of a pipe securely retained in the bore.
Figure 4:
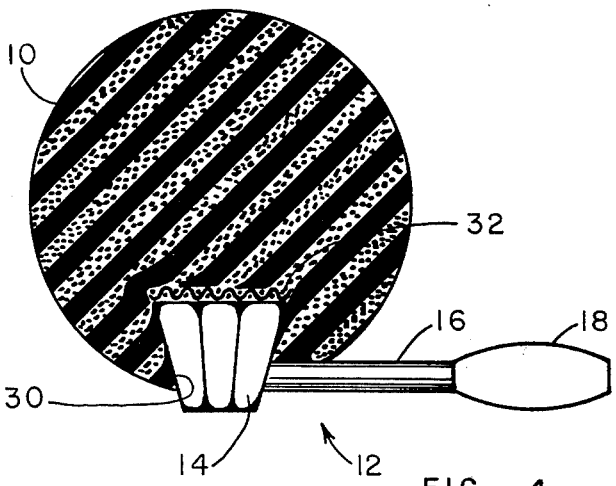
FIG. 4 is an elevational view of the assembled cover of the pipe with the cover and holder in position, the cover and holder being shown in section to illustrate the assembled position of the pipe bowl therein.

The attachement of bowl cover 10 to smoking pipe 12 is best seen in FIGS. 3 and 4 wherein bowl 14 is inserted into bore 30 by elastically urging the sponge rubber material of the cover 10 about the outer peripheral surface of bowl 14. Upper rim 24 of bowl 14 should contact retaining screen 22 so that retaining screen 32 forms an upper wall to close the opening of cup-shaped chamber 20. In this manner, smokable substance 18 is confined within the cup-shaped chamber 20 by retaining screen 32.

It is contemplated in the present invention that the bowl cover 10 hereinbefore described may be used with a variety of smoking pipes. An important consideration however, is that the diameter of the bowl portion 14 of the pipe 12 should be larger in dimension than the diameter of the bore so that the bore 30 may be elastically placed about the bowl 14 to frictionally secure the bowl cover 10 to the bowl 14 of the pipe 12. Another important criterion is that the bowl 14 of the pipe 12 must be of such dimension that its upper rim 24 contacts retaining screen 32 to confine the smokable substance 22 within chamber 20, as mentioned above. Therefore, there is a correlation between the depth of the bore 30, the positioning of retaining screen 32 within bore 30 and the distance between the stem 16 and the upper rim 24 of the bowl 14 of the pipe 12 with which the bowl cover 10 is to be used.

An additional feature of the pipe cover and holder 10 of the present invention resides in its ability to automatically return the pipe to a substantially upright position when placed or dropped on a flat surface. Since the foam material selected to form bowl cover 10 is light in weight relative to the weight of the pipe 12, the difference in weight between the pipe 12 and the bowl cover 10 will place the center of mass of the smoking pipe 12 and cover assembly 10 at a point relatively near the peripheral surface of bowl cover 10 contiguous with the position of the pipe bowl 14. The stable equilibrium for this assembly in a gravitational field is that where the center of mass is lowest, i.e., when the pipe bowl 14 is in an upright position. By making bowl cover 10 somewhat larger than bowl 14, the chances of the assembly 10 coming to rest in an unstable equilibrium position are minimized, and where bowl cover 10 is in the form of a large sphere, the possibility that assembly 10 will come to rest in a position other than that of stable equilibrium is practically nil. Therefore, the pipe bowl 14 will seek to return to a substantially upright position with its opening directed upwardly in the event the pipe and holder assembly be placed on a flat surface with the bowl 14 in other than upright position or dropped onto the floor while a smoker is using the pipe and cover.

In operation, a smokable substance 22 such as tobacco, herbs, or other substance is placed within the open chamber 20 on support screen 28. The smoker lights this substance in a typical manner to achieve a condition of smoldering embers of the substance. Bowl cover and holder 10 is then placed on bowl 14 of the pipe 12 by elastically fitting bore 30 around bowl 14 so that bowl cover 10 is frictionally secured by the elastic properties of the material with retaining screen 32 in flat abutting relationship with upper rim 24 of bowl 14. The smoker may then smoke the pipe 12 by drawing air through bowl cover 10 so that is picks up smoke from the smoldering substance 22, whereupon the air and smoke mixture passes through outlet bore 26, air conduit 27 to the smoker's mouth. Smokable substance 22 is thereby prevented from falling out of bowl 15 since it is trapped within cup-shaped chamber 17 by retaining screen 14, even if the pipe should be upset, dropped, or turned over.

For purposes of illustration, and not of limitation, exemplary characteristics of the preferred form of the invention is provided. The bowl cover and holder 10 is preferably a spherical mass of lightweight, open-celled foam plastic with a diameter of approximately four inches. Numerous thermal plastics well known in the art both have the required characteristics mentioned above and can be made into open-celled foams by processes also known in the art. Examples of materials which may be made into an open-celled foam are polyethylene, urethane, polyvinylchloride and styrene. While these and other thermal plastics are suitable for bowl cover and holder 10, it is desirable that the material exhibit a certain degree of resistance to heat which may be generated by the smoldering smokable substance used in the pipe. The soft resilient bowl cover also serves to cushion the pipe and protect furniture in the event it is dropped. It is also contemplated that a cover and holder could be fabricated of some other substance, such as solid or impervious material with defined air conduits extending from the bore to the peripheral surface. Whatever the material selected, safety considerations mandate that no noxious or poisonous vapors be emitted which could harm the user of the bowl cover and holder.

The pipe 12 has a cylindrical or frusto-conical bowl portion 14 preferably fabricated of wood, although other hard, heat resistant materials such as metal, ceramic, porcelain, etc., would be suitable. The hollow stem 16 is preferably metal, and the mouthpiece 18 is preferably wood, although, again other available materials for the stem and mouthpiece would also be suitable. The bowl 14 is approximately $1\frac{1}{4}''$ high and has a $1\frac{1}{4}''$ diameter upper rim 24 with a $\frac{7}{8}''$ opening into the chamber 20. The combined length of the stem 16 and mouthpiece 18 is approximately $3\frac{1}{4}''$.

The cylindrical bore 30 in the bottom of the cover and holer 10 is approximately $\frac{7}{8}''$ in diameter and $1\frac{1}{4}''$ deep. The support screen 28 and retainer screen 32 can be fabricated of readily available material such as copper, brass, or steel. It is also contemplated that other materials could function in place of a metal screen as long as the material selected has small openings to allow smoke and air to pass therethrough while retaining larger particles such as those comprising the smokable substance. Examples of such materials are glass, glass fibers, quartz and porcelain. It is important that the materials selected for the screen are resistant to the temperatures generated by the smoldering embers of the smokable substance.

Although the present invention has been described with a certain degree of particularly, it is understood that the present disclosure has been made by way of example and that changes in details of the structure may be made without departing from the spirit thereof.

What is claimed is:

1. In a smoker's pipe having a bowl with an upper open end portion at the entrance to a generally cup-shaped chamber adapted to receive a smokable substance, and having a hollow stem member attached to said bowl for conducting smoke from said bowl to the smoker, the improvement comprising:

a bowl cover for retaining said smokable substance, said bowl cover being a spongy mass of open-celled elastic material, said mass having an opening dimensioned to yieldingly receive a portion of said bowl for releasably securing said portion within said mounting bore;

first retaining means mounted in said opening for preventing said smokable substance from directly contacting said bowl cover; and second retaining means mounted within said cup-shaped chamber for preventing said smokable substance from entering said hollow stem member, said first and second retaining means being in spaced apart relation to each other when said bowl is secured within said mounting bore and adapted to cooperate with each other to retain said smokable substance therebetween, said spongy mass being spherical in shape with a diameter at least twice the length between said first and second screens when said bowl cover is secured to said bowl.

2. A pipe cover and holder adapted for covering the bowl of a pipe and for retaining the bowl in an upright position, comprising:

a substantially spherically shaped body portion enlarged with respect to the size of said bowl and having a bore extending radially inwardly from its outer peripheral surface capable of removably receiving the bowl of the pipe, said bore being sized and adapted to substantially engulf and retain the entire bowl such that the bottom of the bowl is substantially aligned with the peripheral surface of the spherical body portion adjacent said bore, said body portion also being of substantially less physical density than said bowl such that the center of mass of the combination of the body portion with the bowl inserted in the bore is positioned between the geometrical center of the spherical body portion and the bottom surface of the bowl; and air passage means in said body portion between said bore and the peripheral external surface of said body portion for conducting air to the bowl of the pipe when positioned in said bore to support combustion of a smokable substance therein and for conducting smoke and other products of combustion from the bowl to the exterior of said body portion.

3. The pipe cover and holder of claim 2, wherein said body portion is comprised of a light, open-celled spongy material, said air passage means being formed by the interconnecting open cells.

4. The pipe cover and holder of claim 3, wherein said spongy material is also a filter in which interconnecting open cells are small and partially obstructed by portions of said spongy material to form small tortuous air passages for filtering out and retaining particulate products of combustion.

5. The pipe cover and holder of claim 4, wherein said spongy material is washable in water for removing the retained particulate products of combustion.

6. The pipe cover and holder of claim 3, including a retainer screen positioned in said bore transverse to the longitudinal axis of said bore a spaced distance inward from the bore opening at the peripheral surface of the sphere approximately equal to the height of the pipe bowl such that said screen contacts the upper end of the bowl when the bowl is fully inserted into the bore to retain the smokable substance within the bowl.

7. A smoker's pipe comprising:

a bowl member including a cup-shaped chamber open at one end for receiving a smokable substance, said bowl member having an outlet bore therein;

a bowl cover for retaining said substance in said bowl member, said cover being an elastic material permeable to air and having a recessed portion extending inwardly from the peripheral surface of the cover adapted to receive and retain the open end portion of said bowl member, said bowl cover being shaped and dimensioned such that at least a portion of its peripheral surface extends laterally outward from the bottom portion of the bowl member when said bowl member is fully inserted into said recessed portion to hold said cup-shaped member in upright position when said bowl cover is placed on a flat surface; and a stem member having a first end secured to said bowl member and having an air passage in communication with said recessed portion for allowing smoke to pass out of said bowl member through said outlet bore and said air passage.

8. A smoker's pipe according to claim 7, wherein said bowl cover is substantially spherical in shape, the center of mass of the assembly of said pipe and said bowl cover is located so that a state of stable equilibrium exists when said bowl member is in a substantially upright position when said assembly is placed on a plane under the influence of a perpendicularly downwardly directed gravitational field.

* * * * *